United States Patent [19]

Harris et al.

[11] 3,961,554

[45] June 8, 1976

[54] METHOD FOR MAKING INCENDIARY LINES FOR ORDNANCE

[75] Inventors: Darrel W. Harris, Colonial Beach; Robert A. Green, McLean; Donald M. Grigsby, Rollins Fork, all of Va.

[73] Assignee: The United States of America as represented by the Secretary of the Navy, Washington, D.C.

[22] Filed: Apr. 8, 1974

[21] Appl. No.: 459,131

[52] U.S. Cl. ..... 86/1 R; 86/20 R; 264/3 R

[51] Int. Cl.[2] ..... F42B 33/00

[58] Field of Search ..... 102/90, 66, 65, 6; 86/1, 20, 20 B; 264/3 R, 322, 261, 262

[56] References Cited

UNITED STATES PATENTS

| | | | |
|---|---|---|---|
| 435,842 | 9/1890 | Lamm | 264/3 R |
| 754,013 | 3/1904 | Von Reichenau | 102/66 |
| 1,039,204 | 9/1912 | Sokolowski | 86/20 B |
| 2,319,014 | 5/1943 | Smith | 264/322 X |
| 2,446,082 | 7/1948 | Dixon | 102/66 |
| 2,960,000 | 11/1960 | Thomas | 86/20 B |
| 3,143,070 | 8/1964 | Bowen | 102/66 |
| 3,292,543 | 12/1966 | Tisch | 102/90 X |
| 3,653,995 | 4/1972 | Selleck | 149/87 |
| 3,825,648 | 7/1974 | Kulkarni | 264/322 X |

*Primary Examiner*—Samuel W. Engle
*Assistant Examiner*—Harold Tudor

[57] ABSTRACT

A slug or billet of incendiary material is placed in a projectile body and both are heated to a temperature at which the incendiary material can easily be formed. A deep drawn metal cup, formed in the shape of the desired explosive cavity, is rammed or forced into the projectile, displacing the incendiary material into the desired configuration and the assembly is then cooled leaving the metal cup in place.

3 Claims, 2 Drawing Figures

METHOD FOR MAKING INCENDIARY LINES FOR ORDNANCE

BACKGROUND OF THE INVENTION

1. Field of the Invention

This invention relates to methods of providing incendiary liners for ordnance items and more particularly to methods for forming such liners directly in place.

2. Description of the Prior Art

The previous method of providing incendiary liners for ordnance items consisted of casting the liner as a separate item and then bonding the precast liners in projectile bodies. This method was not to satisfactory for the following reasons: (1) The separately cast liners must be sized to enter the smallest projectile cavity, (2) Incendiary materials are brittle, and mischmetal is particularly brittle, which necessitates very careful handling prior to insertion in the projectile, and (3) Impurities present in mischmetal from various sources are believed to be incompatible with some explosives.

SUMMARY OF THE INVENTION

The present invention obviates the aforementioned objections by providing a method of casting an incendiary liner in a projectile body and in turn lined with a deep drawn cup which separates the explosive from the incendiary material to obviate any problem of incompatibility. The projectile body and incendiary material are heated to a point where the incendiary material is easily workable and a deep drawn cup is mounted on a ram and forced into the projectile body. The incendiary material is displaced into and fills the space between the projectile cavity and the metal cup. Upon cooling, the ram is withdrawn and the incendiary material and cup remain bonded to each other as well as to the projectile body.

OBJECTS OF THE INVENTION

It is a primary object of this invention to provide a method of making incendiary liners for ordnance items.

It is another object of this invention to provide a method of forming in situ incendiary liners for ordnance items.

It is a further object of this invention to provide a method whereby reactive materials can be formed into liners for projectiles in such a way as to preclude contact of explosive therewith.

DESCRIPTION OF THE PREFERRED EMBODIMENT

Figure 1:
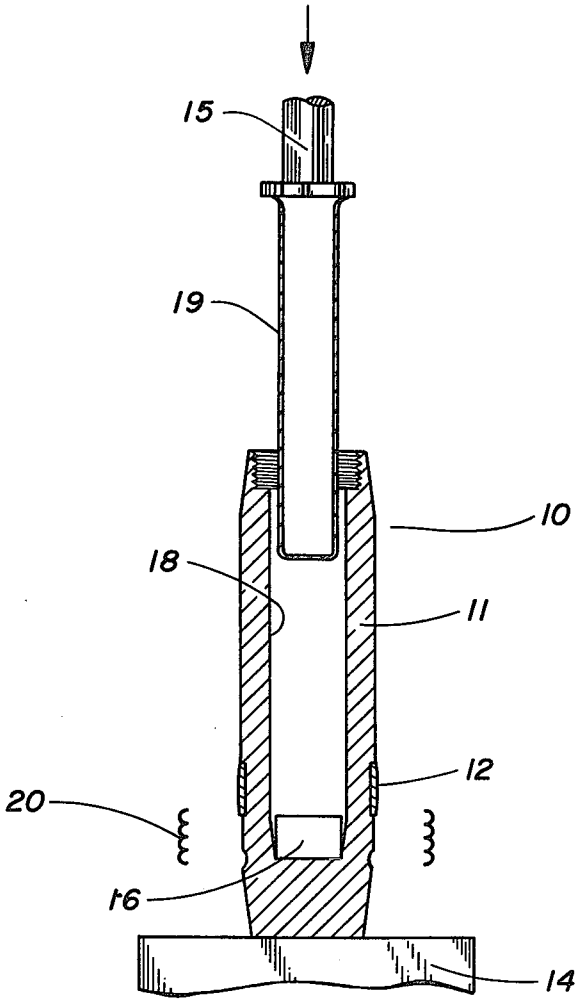
FIG. 1 is a sectional view of a projectile to be lined with incendiary material and including a schematic representation of the apparatus necessary to practice the present invention.

Attention now is directed to the drawings, and more particularly to FIG. 1, wherein there is illustrated a projectile body, designated generally by the reference numeral 10, and comprising a casing 11 and a rotating band 12. The projectile is depicted resting on an anvil or bedplate 14 of a press provided with a ram 15, the actuating mechanism for which is not shown.

A slug 16, of incendiary material such as mischmetal, is placed in a cavity 18 in the projectile 10 and a deep drawn cup 19, of steel or other suitable material, is fitted over the end of the ram 15. The projectile 10 and incendiary material 16 are then heated to a temperature at which the incendiary material may be readily formed. This heating may be accomplished by an induction heater, shown schmatically at 20, or by any other suitable heating means.

Figure 2:
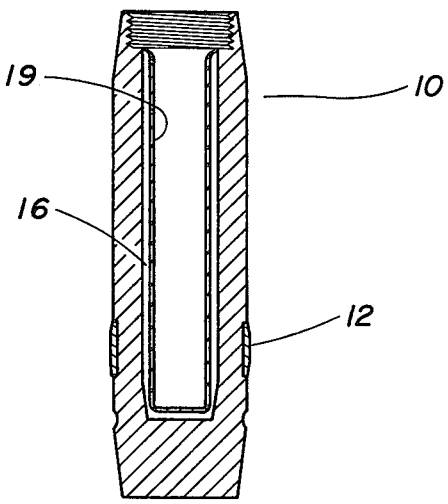
FIG. 2 is a sectional view of a projectile body provided with an incendiary liner by practice of the present invention.

When the forming temperature is reached, the ram 15 carrying the cup 19 is lowered into the cavity 18. This action forces the incendiary material to flow around the end of the cup 19 and to entirely fill the space between the walls of the cavity 18 and the exterior of the cup 19. The ram 15 is then extracted leaving the cup 19 in place and the assembly is then cooled. Upon cooling, the incendiary liner 16 is then mechanically and metallurgically bonded to both the projectile casing 11 and the cup 19. The completed and lined projectile is shown in FIG. 2.

Thus it can be seen that the present invention provides a method of producing incendiary lined ordnance items free of the defects of the prior art methods. The variations in cavity size in the projectile casings does not present a problem when liners are formed in place because each liner is formed to the exact shape and size of the individual cavity. Since the liners are formed directly into the projectile body, it is not necessary to handle brittle liners. The liner is bonded both mechanically and metallurgically to the projectile body and the steel cup. The mischmetal/explosive compatibility problem is eliminated by the steel cup which forms a barrier between them.

The projectile configuration produced by practice of the present invention also obviates certain problems inherent in projectile handling. While the explosives used in modern ordnance items is relatively insensitive to the shocks imposed by dropping during handling, it has been found that explosive cavities which have sharp edges or corners or which are susceptible to the formation of air pockets during filling can lead to inadvertent detonation of the projectiles. The sharp edges or corners can, if the projectile is dropped, cause pinching of a portion of the explosive charge with consequent detonation of the main charge. Air pockets, the volume of which is or can be reduced by shock to the projectile, can cause detonation of the main charge due to adiabatic heating of the entrapped air. The explosive cavity defined by the smooth interior of the cup 19 obviously eliminates these problems.

Obviously many modifications and variations of the present invention are possible in the light of the above teachings. It is therefore to be understood that within the scope of the appended claims the invention may be practiced other than as specifically described.

What is claimed is:

1. A method for producing cast in place incendiary liners in the explosive cavities of ordnance items wherein contact between the incendiary material and the explosive is precluded comprising the steps of:

placing a slug of incendiary material within the cavity of the ordnance item;

heating the ordnance item and incendiary material to a temperature at which the incendiary material may be easily formed;

forcing a deep drawn metal cup into the cavity to displace the incendiary material into the desired liner configuration; and cooling the resulting configuration whereby the incendiary liner is mechanically and metallurgically bonded to both the ordnance item and said metal cup and the recess within said metal cup defines a cavity for the explosive load with intimate contact between the explosive load and said liner being prevented.

2. The method of claim 1 wherein the incendiary material is mischmetal.

3. The method of claim 2 wherein said metal cup is steel.

* * * * *